United States Patent [19]

Salminen

[11] 4,369,970

[45] Jan. 25, 1983

[54] HOCKEY STICK AND METHOD OF MANUFACTURING THE SAME

[76] Inventor: Reijo K. Salminen, 1842 Academy Rd., Bellingham, Wash. 98225

[21] Appl. No.: 56,421

[22] Filed: Jul. 10, 1979

[51] Int. Cl.[3] ..... A63B 59/12

[52] U.S. Cl. ..... 273/67 A; 156/152; 156/290

[58] Field of Search ..... 273/67 R, 67 A, 67 D, 273/67 DA, 80 R, 80.2; 144/317; 156/152, 154, 163, 172, 196, 254, 257, 264, 288, 290, 292, 293, 295, 298, 299, 304.1, 304.5, 306.6, 306.9, 307.1, 313

[56] References Cited

U.S. PATENT DOCUMENTS

| | | | |
|---|---|---|---|
| 556,042 | 3/1896 | Briggs | 273/80.2 |
| 1,026,181 | 5/1912 | Seely | 273/80.2 |
| 2,023,728 | 12/1935 | Evernden | 273/67 A |
| 2,260,218 | 10/1941 | Evernden | 273/67 A |
| 2,371,305 | 3/1945 | Marks | 156/152 |
| 2,504,242 | 4/1950 | Yerger | 273/67 A |
| 3,677,542 | 7/1972 | Michaud | 273/67 A |

FOREIGN PATENT DOCUMENTS

| | | | |
|---|---|---|---|
| 447077 | 3/1948 | Canada | 273/67 A |
| 455116 | 3/1949 | Canada | 273/67 A |
| 2637228 | 8/1978 | Fed. Rep. of Germany | 273/67 A |
| 84147 | 8/1935 | Sweden | 273/67 A |
| 15991 | of 1897 | United Kingdom | 273/80.2 |
| 261 | of 1899 | United Kingdom | 273/67 DA |
| 9979 | of 1911 | United Kingdom | 273/80 R |

*Primary Examiner*—Richard J. Apley

*Attorney, Agent, or Firm*—Hughes, Barnard & Cassidy

[57] ABSTRACT

The shaft of the stick is formed with a downward taper at the lower end, with the two sides surfaces of the shaft having an outer lamination of high strength fiberglass material. To form the blade portion of the stick, two blanks are formed from a thin wood veneer sheet and the two toe ends of the blanks are bonded together, while the rear heel ends of the blanks are separated moderately. The heel ends of the two blanks are placed on opposite sides of the lower tapered end of the shaft and bonded thereto. Then the space between the blanks is filled with an epoxy glue which hardens to form the completed blade.

39 Claims, 25 Drawing Figures

(a)

(c)

(d)

(b)

(a)

(b)

(a)

HOCKEY STICK AND METHOD OF MANUFACTURING THE SAME

BACKGROUND OF THE INVENTION

The present invention relates to hockey sticks and a method of making the same.

In a conventional hockey stick there is an elongate shaft, and a blade extending outwardly from the lower end of the shaft at an angle of about 40° to 50° from the longitudinal axis of the shaft. The heel portion of the blade (i.e. that portion which joins the shaft) is moderately thinner than the thickness dimension of the shaft, and the thickness dimension of the blade decreases toward the toe end of the blade. Also, the lower part of the blade is generally made thicker, with the upper edge of the blade being relatively thin (e.g. an ⅛ of an inch).

The lower end of the shaft is generally formed with a gradual downward taper which contours smoothly into the configuration of the blade. This is done for two reasons. First, by removing excess material at the lower end of the shaft, the stick becomes lighter to handle. Second, for reasons of esthetics it is desirable to form the stick with more graceful contours.

One of the problems involved with the prior art hockey stick that is currently in common use is the manufacturing time in achieving the proper contour of the lower end of the stick. While this prior art method will be described in more detail later herein, with reference to FIG. 1*a* through *d*, it can be stated generally that this is accomplished by first joining the component parts one to another, and then subjecting the assembled components to a grinding or "sanding" operation to remove excess material and provide the proper contours. This considerable amount of precision grinding adds substantially to the overall expense of manufacture.

Another problem with the general type of hockey stick presently being used involves the durability of the stick. The blade portion of the stick must have a certain amount of flexibility so that the player can obtain the proper "feel" in handling the puck and executing the shots. However, the stick is subjected to very substantial impacts, for example in the player executing a very hard "slap shot". It is not uncommon for a hockey stick to break after the execution of perhaps as many as fifty slap shots. Generally the stick breaks along the lower portion of the shaft, at the middle of the blade, or at the joint of the blade and the shaft. It is not an adequate solution to simply place more reinforcing material in the lower part of the stick, since this would add to the weight at the lower end of the stick and depart from the desired contour.

With regard to the patent literature relating to hockey sticks, a number of United States patente were disclosed in a patentability search. While these are not considered to be closely relevant to the teachings of the present invention, these are being cited herein to be sure that the applicant is complying with his responsibility in making a full disclosure to the U.S. Patent and Trademark Office.

U.S. Pat. No. 1,438,030, Hall, discloses a hockey stick where the blade is formed of upper and lower pieces, with upper extensions of the blade fitting on opposite sides of the shaft.

U.S. Pat. No. 1,564,125, Cordwell, shows a hockey stick or paddle where the grain of wood has a particular orientation with alignment of the stick.

U.S. Pat. No. 1,601,116, Hall, discloses a hockey stick having various tongue and groove connections between the shaft and the blade. U.S. Pat. No. 1,631,960, Hall, shows yet another tongue and groove connection by which the blade is connected to the shaft.

U.S. Pat. No. 1,821,889, Glahe, shows a hockey stick having reinforcement pieces inserted into the blade.

U.S. Pat. No. 2,023,728, shows a hockey stick where the blade and handle are joined by an intermediate piece. This intermediate piece has a double wedge configuration and fits in V-shaped recesses in the shaft and blade.

U.S. Pat. No. 2,304,322, Werlich, has a hockey stick where the shaft is bifurcated at its lower end to receive the blade.

U.S. Pat. No. 2,334,860, Berger, shows another hockey stick where the blade is attached to the shaft by a tongue and groove connection.

U.S. Pat. No. 2,569,395, Zupanick, employs a laminated shaft having at its lower end a "V" slot to receive a tapered tongue at the heel of the blade. The blade itself is laminated and has a tapered configuration.

U.S. Pat. No. 2,730,367, Bublik, also shows a blade having a tongue member which fits into a slot in the shaft. Cane strips bonded by adhesive are employed to add strength.

U.S. Pat. No. 3,638,942, Bassett, shows a blade having a socket which receives the end of the shaft. Either the blade or the shaft are replaceable.

U.S. Pat. No. 3,982,760 utilizes a material along the bottom edge of the blade to prevent excessive wear and thus prevent delamination of plastic laminates along the sides of the stick.

U.S. Pat. No. 4,013,288 shows the stick made as a single injection molded piece.

U.S. Pat. No. 4,084,818, Goupil et al, winds the blade portion of the stick with a thin filament, such as fiberglass yarn.

U.S. Pat. No. 4,086,115, Sweet et al, utilizes a shaft made of fiberglass and having a hollow recess. A tongue portion of the blade fits into the lower end of the shaft.

SUMMARY OF THE INVENTION

In the method of the present invention, there is first formed a shaft with an end taper. This shaft has a longitudinal axis, a bladewise axis, and a transverse axis perpendicular to the longitudinal axis and the bladewise axis. The shaft has a core portion and two side surface portions positioned generally parallel to the bladewise axis and the longitudinal axis. Further, the shaft has an upper end portion and a lower end portion. The taper is formed at the lower end portion in a manner that the side surface portions converge downwardly and inwardly along said lower end portion to a location proximate a lower end of the shaft.

Then two blade blanks are attached to the lower end portion of the shaft. These blanks each have a front toe portion and a rear portion joining to the lower end portion of the shaft. The blanks have the toe portions thereof joined to one another and diverging rearwardly from one another to provide an interior blade space therebetween. The interior blade space is filled with a hardenable filler material to form a finished blade.

A preferred method of forming the end taper in the shaft is to form the core portion of the lower end of the shaft with an upwardly extending tapered groove to form the lower end portion of the shaft as two tapered leg portions. These two leg portions are then joined one to another. Desirably, a filler material is placed between the two leg portions so that the two leg portions are joined one to another through the filler material.

A further improvement is to form at least one slot (desirably a pair of slots) in the lower end portion of the shaft, and insert a reinforcing member in the slot (or insert two reinforcing members in the two slots). The reinforcing member has a web portion extending forwardly from the shaft into the interior blade space.

Preferably, the side surface portions of the shaft are made as two laminated portions, each having an inner layer and an outer layer of fiber reinforced material. Desirably the fiber reinforced material is a fiberglass mat.

More specifically, each blank is provided with a rear ankle portion. The two blanks are attached to the shaft by bonding the ankle portions to side surface portions of the lower end portion of the shaft.

To obtain the desired configuration of the blade, the two blanks are joined to one another in a manner that upper edges of the blanks are joined together from the toe portions of the blanks rearwardly to form an upper bonded edge. The lower edge portions of the blanks below the upper bonded edge are spaced from one another, with the result that after the interior blade space is filled with the hardenable filler material, the finished blade has a configuration that diverges downwardly from an upper edge of the blade.

A preferred manufacturing technique is joining the blanks together by laying the blanks one against the other and placing a separating member between rear portions of the blanks. The separating member has a forward separating edge that extends from the upper edges of the blanks downwardly and forwardly toward the lower edges of the blanks. Thus there is formed a bonded area which reaches upwardly and rearwardly along said blanks.

The hockey stick made according to the present invention has an end configuration whereby the lower end of the shaft of the hockey stick tapers downwardly and inwardly. The two side surface portions of the shaft are load bearing members which extend to a location proximate the lower end of the shaft. The two blanks become in the end configuration of the hockey stick two blade surface portions joined to one another at the toe portion and diverging rearwardly from one another to join to the lower tapered end portion of the shaft. The blade is reinforced by the hardened filler material occupying the space between the two blade surface portions.

Desirably, the hockey stick has one or more reinforcing members positioned in slots in the lower end portion of the shaft, with the reinforcing members extending into the hardened filler material.

For a proper contour of the hockey stick, the blanks which become the blade surface portions each have a rear ankle portion which is bonded to the side surface portions of the lower end of the shaft. Other features of the invention will become apparent from the following detailed description.

BRIEF DESCRIPTION OF THE DRAWING

FIG. 1*c* shows the same components of FIG. 1*a* with a receiving slot formed in the connecting member;

FIG. 1*d* shows the completed prior art hockey stick with the blade inserted in the receiving slot and the outer contour of the shaft ground to the proper configuration;

DESCRIPTION OF THE PREFERRED EMBODIMENT

It is believed a clearer understanding of the present invention will be obtained by first describing, with reference to FIGS. 1*a* through 1*d* the common method for manufacturing the prior art hockey stick now commonly in use. After that, there will be a detailed description of the method of the present invention followed by a more detailed description of the characteristics of the hockey stick of the present invention.

Figure 1B:
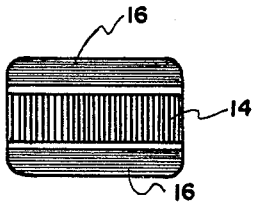
FIG. 1b PRIOR ART
FIG. 1*b* is a sectional view taken at line 1*b*—1*b* showing the cross section of the shaft of the prior art hockey stick.
Figure 1:
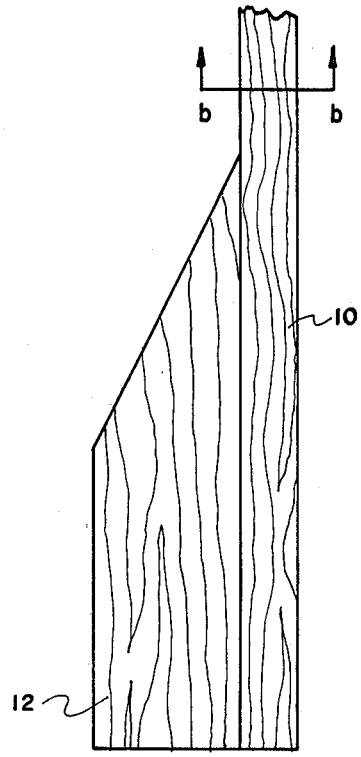
FIG. 1 PRIOR ART
FIG. 1 is a perspective view showing an initial joinder of a shaft and a connecting member as a first step in making a conventional prior art hockey stick.
Figure 1:
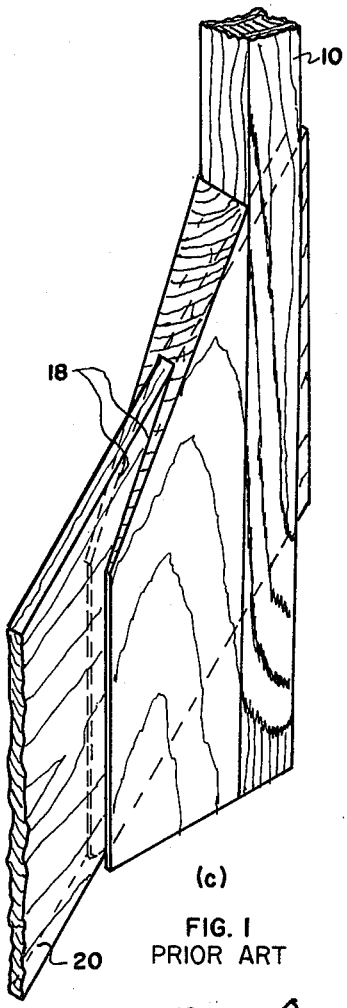
FIG. 1 PRIOR ART
Figure 1:
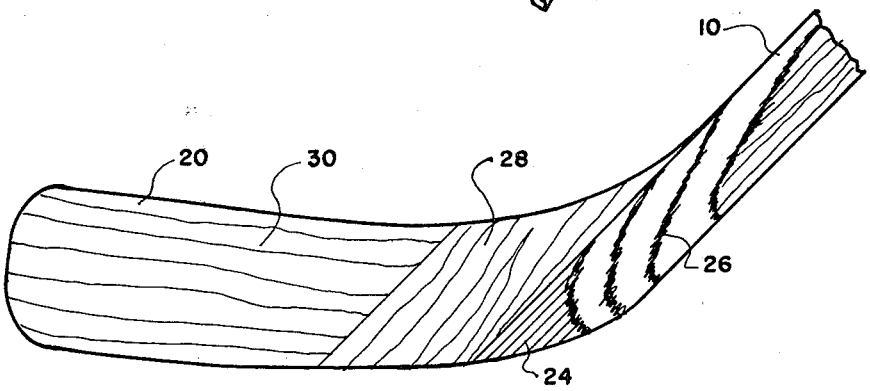
FIG. 1 PRIOR ART

As shown in FIG. 1*a*, the initial step in manufacturing a prior art hockey stick is to provide an elongate shaft 10 (only the lower part of the shaft 10 being shown in FIG. 1*a*) and joining to that shaft 10 (e.g. by bonding) a trapezoidal connecting member 12. As can best be seen in FIG. 1*b*, quite commonly the shaft 10 has a core section 14 and two side laminated sections 16. Generally, the laminated sections 16 are made of a higher quality veneer wood product, and can withstand greater unit force loads, while the core section 14 (being stressed to a relatively lesser extent) can be a combination of laminated members, some of which are less able to withstand high loading.

With the connecting member 12 being bonded to the shaft 10, the next step, as shown in FIG. 1*c*, is to cut an elongate groove or slot 18 into the forward portion of the connecting member 12. Next, a blade member 20 is inserted into the slot 18 and bonded to the connecting member 12. With the basic components of the hockey stick now assembled and bonded together, the next step is to contour this assembly into a finished product indicated at 22 in FIG. 1*d*. First, the heel portion 24 is rounded off, for example by grinding or sanding. Next, there is a grinding action to provide a gradual taper along the lower side surfaces 26 of the shaft 10. This grinding is continued into the side portions 28 of the connecting member 12 so that it follows a gradual contour from the surface 26 to the side surface 30 of the blade 20. These grinding or material removal operations result in the conventional configuration of the hockey stick 22 shown in FIG. 1*d*. After the grinding operation, the lower shaft and blade surfaces are reinforced with a fiberglass resin mat.

When the hockey stick 22 is used for a period of time and subjected to a number of very hard impacts (e.g. used in a slap shot), it is not unusual for the hockey stick 22 to break. Generally, the break will occur in the lower portion of the shaft 12, at the middle of the blade, or at the joint between the shaft and the blade. This is not unexpected, since in the final grinding operation the side material of the shaft (i.e. the side laminated portions 16) is ground away thus diminishing the ability of the lower portion of the shaft to withstand bending moments.

It is with the foregoing problems in mind that the present invention was conceived. More particularly, the present invention was designed to provide relatively fast and inexpensive manufacturing, and also an end product which has relatively high ability to withstand a series of hard impacts.

Figure 2:
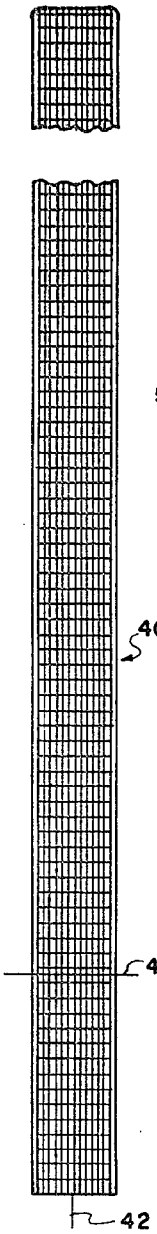
FIG. 2 is a side view of a shaft member used in the present invention to make a hockey stick.

To proceed now to a description of the present invention, the first step is to form the lower end of a shaft to the desired tapered configuration. In FIG. 2, there is shown a shaft 40 which is or may be of conventional design. This shaft 40 has a lengthwise axis indicated at 42, coinciding with the lengthwise dimension of the shaft 40. There is a bladewise axis 44 which is perpendicular to the longitudinal axis 42, and which in the end configuration of the hockey stick is generally aligned in a vertical plane with the axis of the blade of the hockey stick. Finally, there is a transverse axis 46 which is perpendicular to both the longitudinal axis 42 of the bladewise axis 44.

Figure 4:
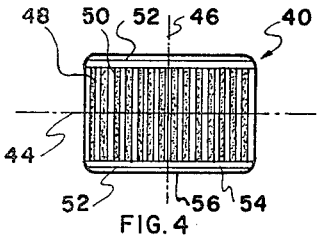
FIG. 4 is a cross-sectional view of the shaft, taken along line 4—4 of FIG. 3.

With further reference to FIG. 4, the shaft 40 has a core section 48 which as shown herein is made up of a plurality of core laminations 50 parallel to both the longitudinal axis 42 and the transverse axis 46. Further, the shaft 40 comprises two side portions 52 positioned at the side surfaces of the shaft 40 and parallel to the bladewise axis 44 and the longitudinal axis 42. Each side laminated portion 52 can be made up of one or more laminations. As shown herein, there is an inner lamination 54 of a high strength wood veneer, and an outer lamination 56 of a fiberglass resin mat having relatively high tensile strength.

Figure 3:
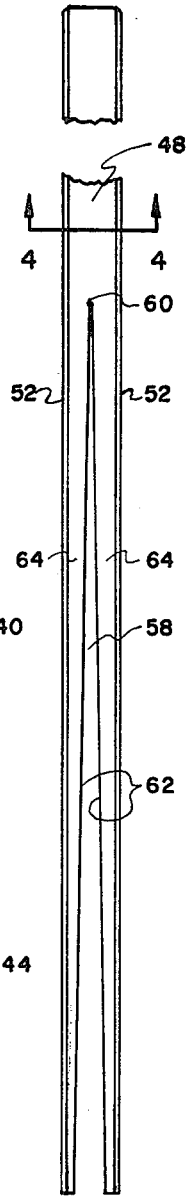
FIG. 3 is a front view of the shaft of FIG. 2, showing a first step in the method of the present invention where an interior V-shaped groove is formed in the shaft.

Initially the lower end of the shaft 40 is formed with an elongate groove 58 which tapers gradually inwardly in an upward direction to an apex line 60. The two sides 62 which define the groove 58 are generally parallel with the laminated side portions 52, but slant moderately therefrom. Thus, the lower end of the shaft 12 is formed with two downwardly tapering legs 64, as shown in FIG. 3.

Figure 5:
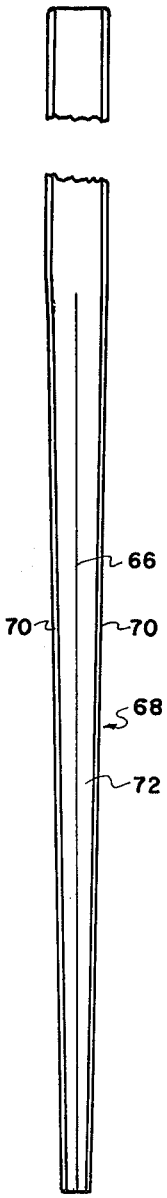
FIG. 5 shows a second step in the method of the present invention, where the two lower side portions of the shaft are brought together to make a tapered shaft configuration.

Next, as shown in FIG. 5, a thin sheet of filler material 66 can be placed in the groove 58, with a bonding medium (i.e. glue) placed therein; and the two legs 64 are pressed together and bonded to the filler material 66. The reason for using the filler material 66 is that in sawing into shaft 42 to make the groove 58, it may be that the apex line 60 will have a certain width dimension, and that it will not be possible to fill the gap adjacent the line 60 simply by pressing the two legs 64 together. Thus, by inserting the filler sheet 66 into the gap 58, the lower end of the shaft 40 becomes a single tapered section without any discontinuities in the core. However, the filler material may not be needed if the apex line 60 is quite thin.

From the examination of FIG. 5, it can be seen that the shaft 40 now has a lower downwardly and inwardly tapered end portion 68. This lower end portion has two lower side laminate sections 70 and a gradually tapered core section 72.

While the method of forming the tapered shaft section 68 disclosed immediately above is presently believed to be the most practical method, within the broader aspects of the present invention, it is contemplated that some other method could be used to arrive at the general configuration shown in FIG. 5. For example, the two side surface portions of the lower end of the shaft 40 could be cut inwardly at an angle, after which lower side laminate portions could be reapplied to the sides of the lower portion of the shaft 40. However, it is presently believed that this would add complexities not present in the preferred method disclosed herein.

Figure 6:
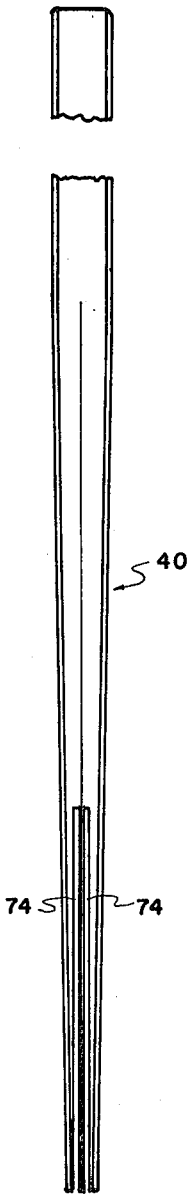
FIG. 6 shows a subsequent step where two receiving grooves are formed in the lower end of the shaft.
Figure 7:
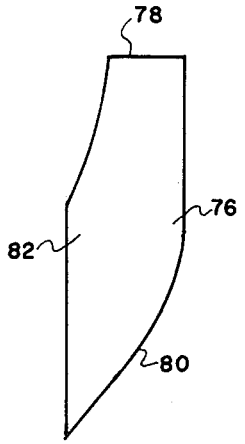
FIG. 7 shows one of two joining or reinforcing members used in the method of the present invention.
Figure 8:
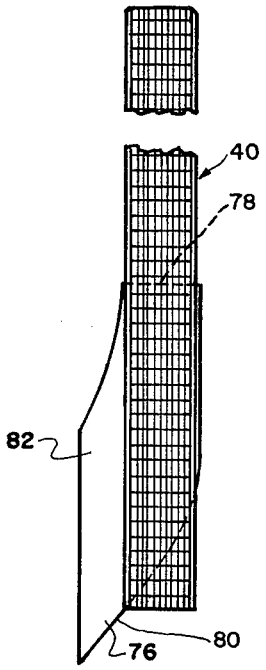
FIG. 8 is an elevational view of the lower end of the shaft showing one of the joining members of FIG. 7 in its installed position.

With reference to FIG. 6, the next step is to cut two upwardly extending grooves 74 into the lower end of shaft 40. These grooves 72 are approximately parallel to the laminated side portions 52. Then a pair of reinforcing members 76 are inserted into the slots 74 in the lower end of the shaft 40. Each reinforcing member 76 as shown in FIG. 7 has a generally planar configuration, with an upper edge 78 which fits against the upper edge of its related slot 74. It also has a rear rounded heel portion 80 which would correspond generally to the configuration of the heel contour of the hockey stick which is the end product. Additionally, each reinforcing member 76 has a forward web portion 82 which extends beyond the forward surface of the shaft 40, as shown in FIG. 8. These reinforcing members 76 can be made, for example, from high quality wood veneer, or some other high strength material.

Figure 9:
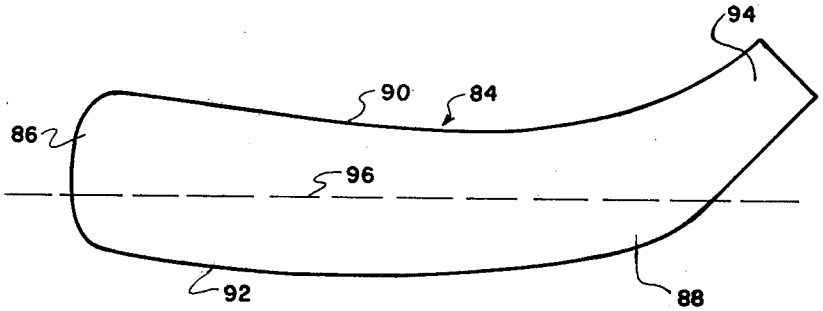
FIG. 9 is a side elevational view of one of two blanks used in forming the blade in the present invention.

To form the blade portion of the hockey stick, there are first provided two blade blanks, one of which is shown at 84 in FIG. 9. Each blank 84 can be stamped from, for example, a high quality wood veneer or some other suitable material. Each blank 84 can be considered as having a forward toe section 86, a rear lower heel portion 88, an upper edge 90, a lower edge 92, and a rear ankle portion 94 extending upwardly and rearwardly from the heel 88 at approximately a 40° to 50° angle to the lengthwise axis 96 of the blank 84.

Figure 10:
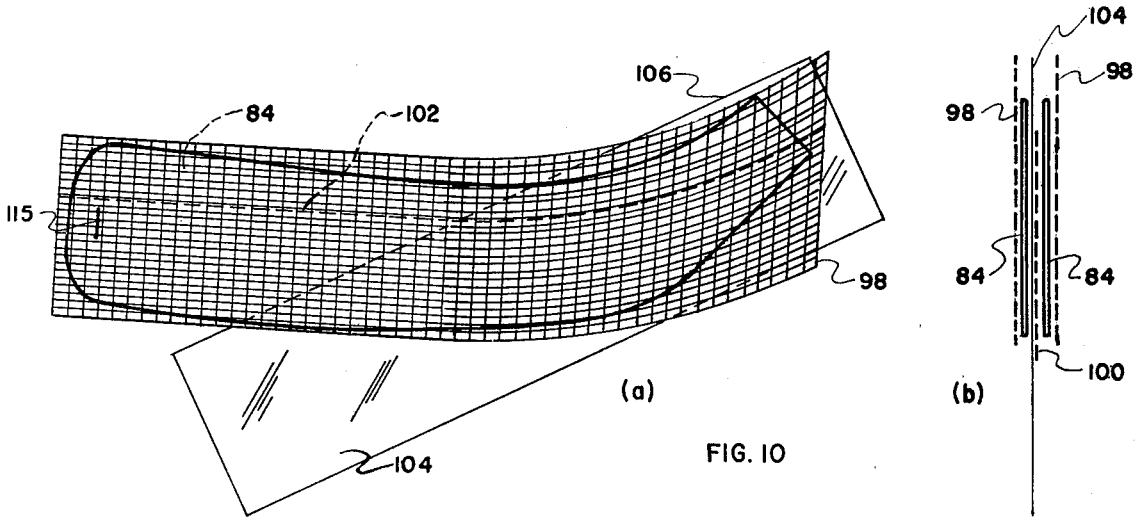
FIG. 10*a* is a side elevational view of a manufacturing layup whereby portions of two blanks are bonded one to another and further laminations are applied to the blanks.
FIG. 10*b* is a front elevational view of the layup of FIG. 10*a;*

A pair of blanks 84 are layed against one another in a stack-up such as shown in FIGS. 10*a* and 10*b*. There are two fiberglass mats 98 placed outside of, and on opposite sides of, the two blanks 84. Such fiberglass mats are well known in the prior art, and comprise a plurality of interwoven fiberglass strands impregnated with a suitable resin. Also, there is an inner fiberglass mat 100, extending the length of the two blanks 84, and having an upper edge 102 at approximately the mid-height of the blanks 84. The reason for this intermediate fiberglass mat 100 is to provide added reinforcing to the lower portion of the blanks 84 which are to be part of the finished blade of the hockey stick. Also, there is a plastic separating sheet 104, placed between the rear and lower middle portions of the two blanks 84. To state this more precisely, the separating sheet 104 has an upper edge 106 which extends forwardly and downwardly to terminate at a lower location approximately midway between the forward toe end 86 and the midlength of the blank 84.

A suitable adhesive (e.g. an epoxy glue or a polyester glue) is applied to the components in the stack-up of FIGS. 10*a* and 10*b* so that these components become glued together, except that the two blanks 84 do not become bonded one to another along the surface area of the separating sheet 104. Thus, as can best be seen in FIG. 12, there is a forward bonded area 108 and a rear unbonded area 110 between the two blanks 84. Thus, the upper bonded edge 112 of the two blanks extends moderately beyond the mid-length of the two blade blanks 84, while the lower bonded edge 114 extends only moderately from the forward toe section 86. During bonding the blanks 84 can be held together, for example, by one or more staples, as at 115.

The bonding is accomplished by placing the assembly of FIGS. 10*a* and 10*b* (or a plurality of such assemblies) in a press that gives a desired curved configuration corresponding to the final configuration of the blade of the hockey stick. Since the method of pressing and curing material is well known to the prior art, there is only shown herein schematically the end curved configuration of the two blanks, as in FIGS. 11*a* and 11*b*.

Next, the two ankle portions 94 have the interior portions thereof formed with a taper so that the upper rear edge portions 116 are formed as a very narrow line. This can be done, for example, by placing a grinder with a tapered edge portion into the area between the two ankle portions 94.

Figure 11:
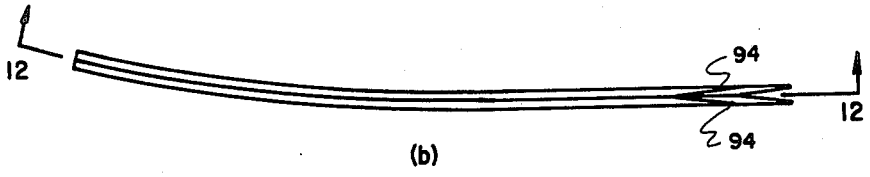
FIG. 11*a* is a side view of a pair of blanks resulting from the manufacturing layup of FIG. 10, and showing the end heel portions of these blanks provided with a tapered configuration.
FIG. 11*b* is a top view of the two blades shown in FIG. 11.
Figure 11:
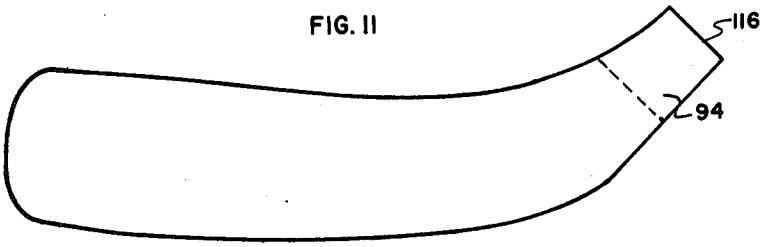
Figure 12:
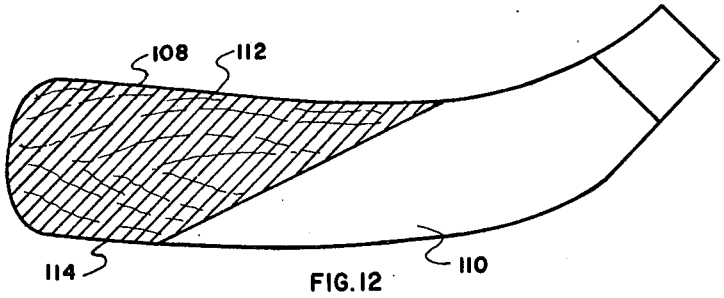
FIG. 12 is a sectional view taken along line 12—12 of FIG. 11*b*, and illustrating the bonded area of the two blanks of FIG. 11.
Figure 13:
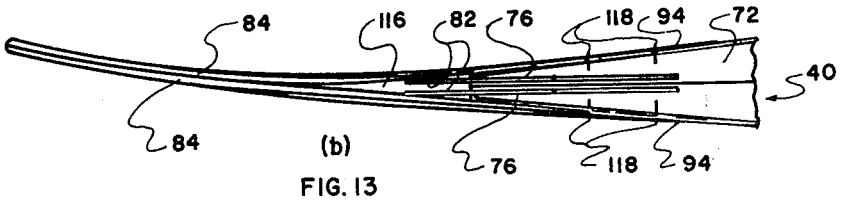
FIG. 13*a* is a side elevational view showing the two assembled blanks of FIG. 11 joined to the lower end of the shaft and connecting member assembly of FIG. 8.
FIG. 13*b* is a bottom view of the assembly of FIG. 13*a;*
Figure 13:
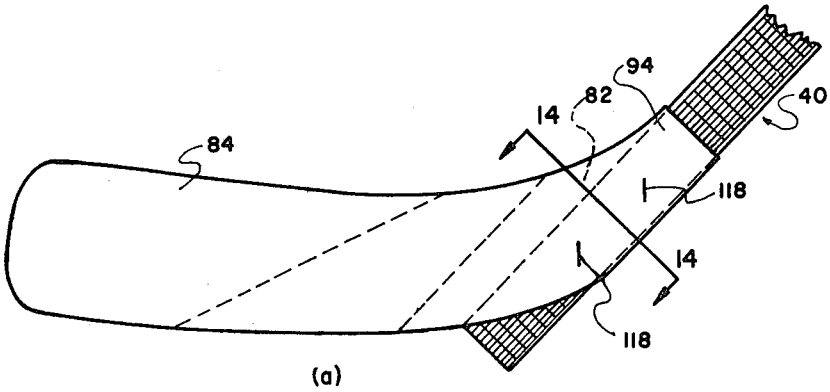
Figure 14:
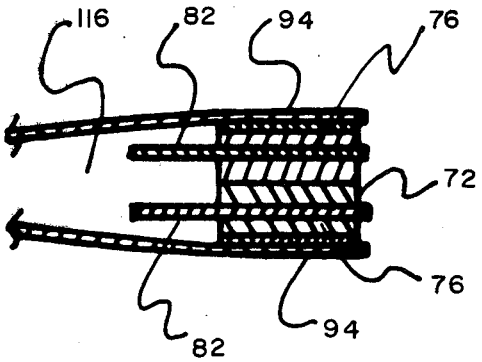
FIG. 14 is a sectional view taken along line 14—14 of FIG. 13.
Figure 17:
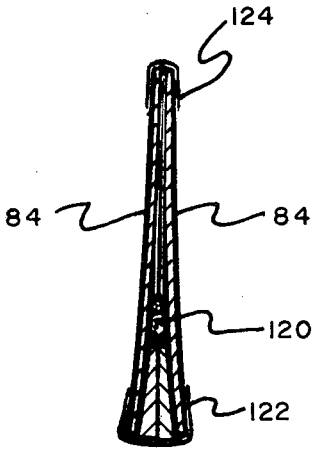
FIG. 17 is a sectional view taken along line 17—17 of FIG. 16.
Figure 15:
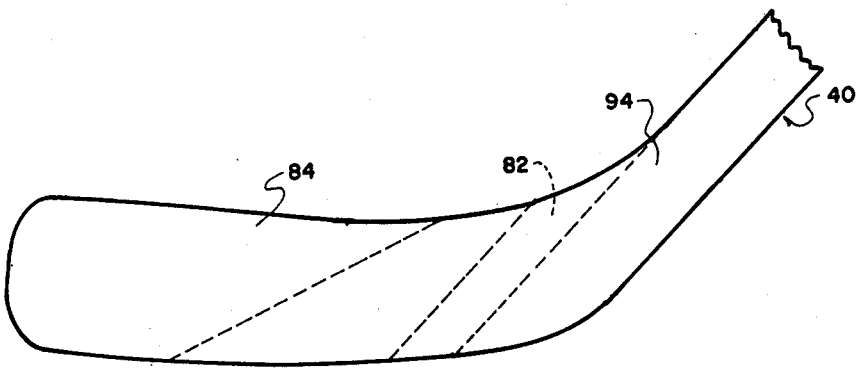
FIG. 15 shows the assembly of FIG. 13 with excess shaft material removed from the assembly.

The next step is to take the bonded blade assembly shown in FIGS. 11*a* and *b*, and also shown in FIG. 12, and bond this to the stick and reinforcing member assembly shown in FIG. 8. The resulting assembly is shown in FIGS. 13*a* and 13*b*. It can be seen that the rear portion of the two blanks 84 become positioned on opposite sides of the lower portion of the shaft 40. The two forwardly extending web portions 82 of the reinforcing member 76 extend into the open space 117 between the two blanks 84. The rear portions of the blanks 84 can be temporarily secured to the lower end of the shaft 40 in some suitable manner as by staples, indicated at 118. In making the stack-up of FIG. 13*a* and 13*b*, an adhesive material is applied between the side surfaces of the shaft 40 and the contiguous inner surfaces of the blanks 84, so that these become bonded to one another. After the bonding is completed, the lower portion of the shaft 40 extending below the heel portion 88 of the blanks 84 is removed in some suitable manner, such as by grinding. The resulting assembly is that shown in FIG. 15.

Next, the lower middle portions of the two blanks 84 are spaced moderately from one another by placing a suitable spacing element 120 therebetween. This can be done, for example, by wedging a small wood chip 120 between the two blanks 84. The effect of this is to insure that the lower edge portions of the blanks rearwardly of the lower bonded edge 114 are spread adequately from one another to give the desired thickness to the lower portion of the blade in the end configuration of the hockey stick.

Figure 16:
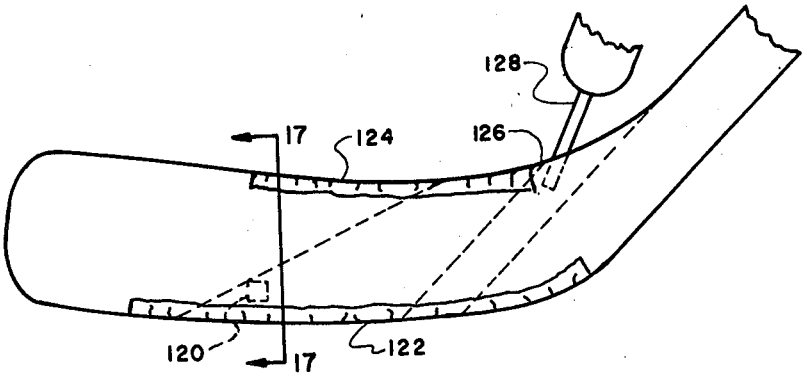
FIG. 16 illustrates the manner in which a glue material is inserted into the assembly of FIG. 15.

The middle and rear bottom edge portions of the two blanks 84 are then temporarily covered in some suitable manner, such as applying tape 122 to the lower edge portions. In like manner, the upper open edge portions of the two blanks 84 are temporarily covered by a tape 124, with the rear end of the upper edge portion being left open, as at 126. Then, the entire open space 116 between the two blanks 84 is filled with a suitable material, such as an epoxy glue which will solidify to form a strong structural filler material which is securely bonded to all of the components with which it comes into contact. One method of doing this is illustrated schematically in FIG. 16, where there is shown a nozzle 128 protruding through the opening 126 to inject an epoxy glue into the open space 116.

With the epoxy filler material hardened and completely filling the space 116 between the blanks 84, the hockey stick which is to be the end product is essentially completely formed. The tapes 122 and 124 are then removed. It may be necessary to perform a small amount of grinding to remove any rough edges, but this amount of grinding should not be very time consuming.

Figure 18:
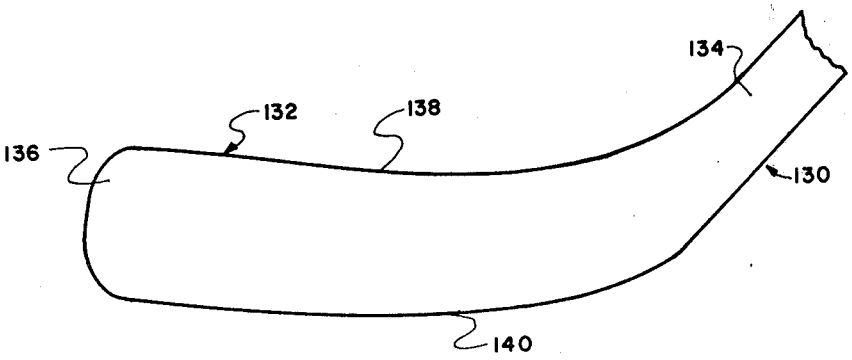
FIG. 18 is a side elevational view of the completed hockey stick of the present invention.
Figure 19:
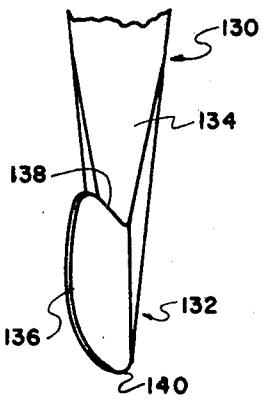
FIG. 19 is a front elevational view of the stick of FIG. 18.

With regard to the end configuration of the hockey stick, reference is now made to FIGS. 18 and 19. In this hockey stick which is the end product, the shaft is designated 130 while the blade is designated 132. It will be noted that the shaft 130 has a lower tapering portion 134, and that the two laminate side portions 52 of the original shaft members 40 extend downwardly, uninterrupted, to the extreme lower end of the shaft 130. Since these two laminate side portions 52 are of a relatively high strength material, the entire length of the shaft 130 is readily able to resist the bending moments imposed thereon by severe impact blows against the blade 132. Further, the taper of the lower portion of the shaft 130 is such as to blend into the contour of the blade 132. With regard to the means of joining the blade 132 to the shaft 130, it is noted that the two reinforcing members 76 are securely bonded in the shaft 130, and also are embedded in the epoxy glue that fills the space 116 between the two blanks 84. Also, the upper rear ankle portions 94 of the blanks 84 are securely bonded to the sides of the lower end 134 of the shaft 130 and blend into the sides of the shaft 130.

The blade 132 has the desired end configuration of a high quality hockey stick. More specifically, the forward portion 136 of the blade 132 is made relatively thin, and thus has moderate flexibility, while having adequate strength. The upper edge 138 of the blade 132 is quite narrow along a substantial portion of the upper edge, and then broadens toward the rear portion of the blade 132 to blend into the contour of the lower portion 134 of the shaft 130. On the other hand, the lower edge 140 of the blade 132 is broader relative to the upper edge 138 so that the lower portion of the blade 132 has the required thickness for strength in that area.

What is claimed is:

1. A method of making a hockey stick, said method comprising:

a. forming a shaft with an end taper, said shaft having a longitudinal axis, a bladewise axis, and a transverse axis perpendicular to the longitudinal axis and the bladewise axis, said shaft having a core portion and two side surface portions positioned generally parallel to the bladewise axis and the longitudinal axis, said shaft having an upper end portion and a lower end portion, said taper being formed at said lower end portion in a manner that said side surface portions converge downwardly and inwardly along said lower end portion to a location proximate a lower end of said shaft, b. providing two blade blanks, said blanks each having a front toe portion and a rear portion, joining the toe portions to one another and attaching the rear portions to the shaft in a manner that the blade blanks diverge rearwardly from one another to provide an interior blade space therebetween, and c. filling said interior blade space at least partially with a hardenable filler material to form a finished hockey stick.

2. The method as recited in claim 1, further comprising forming said end taper by forming in the core portion of the lower end of the shaft an upwardly extending tapered groove to form the lower end portion of the shaft as two tapered leg portions, and then joining said leg portions one to another.

3. The method as recited in claim 2, further comprising placing a filler material between said two leg portions so that said two leg portions are joined one to another through said filler material.

4. The method as recited in claim 2, further comprising forming at least one slot in the lower end portion of the shaft, and inserting a reinforcing member in said slot, said reinforcing member having a web portion extending forwardly from said shaft into said interior blade space.

5. The method as recited in claim 2, further comprising forming two slots in the lower end portion of the shaft, and inserting in said slots a pair of reinforcing members, said reinforcing members each having a web portion extending into said interior blade space.

6. The method as recited in claim 1, further comprising forming at least one slot in the lower end portion of the shaft, and inserting a reinforcing member in said slot, said reinforcing member having a web portion extending forwardly from said shaft into said interior blade space.

7. The method as recited in claim 1, further comprising forming two slots in the lower end portion of the shaft, and inserting in said slots a pair of reinforcing members, said reinforcing members each having a web portion extending into said interior blade space.

8. The method as recited in claim 1, further comprising providing said side surface portions as two laminated portions, each having an inner layer and a outer layer of fibre reinforced material.

9. The method as recited in claim 8, wherein said fibre reinforced material comprises a fibre glass mat.

10. The method as recited in claim 1, further comprising providing each blank with a rear ankle portion, and attaching said blanks to said shaft by bonding said ankle portions to the side surface portions of the lower end portion of the shaft.

11. The method as recited in claim 10, further comprising joining said blanks to one another in a manner that upper edges of said blanks are joined together from the toe portions of the blanks rearwardly to form an upper bonded edge, with lower edge portions of the blanks below the upper bonded edge being spaced from one another, whereby after said interior blade space is filled with said hardenable filler material, the finished blade has a configuration which diverges downwardly from an upper edge of the blade.

12. The method as recited in claim 11, wherein said blanks are joined to one another by laying said blanks one against the other and placing a separating member between rear portions of the blanks, said separating member having a forward separating edge that extends from the upper edges of the blanks downwardly and forwardly toward the lower edges of the blanks, whereby there is formed a bonded area which reaches upwardly and rearwardly along said blanks.

13. The method as recited in claim 11, wherein said blanks are joined one to another by laying said blanks one against the other, placing fibre reinforced material against outside surfaces of said blanks, placing a separating member between rear portions of said blanks, and then bonding said blanks and said fibre reinforced material so that fibre reinforced laminations are formed on exterior surfaces of said blanks, while rear portions of said blanks are separated from one another.

14. The method as recited in claim 1, further comprising:

a. forming said end taper by forming in the core portion of the lower end of the shaft an upwardly extending tapered groove to form the lower end portion of the shaft as two tapered leg portions, and then joining said leg portions one to another b. providing each blank with a rear ankle portion, and attaching said blanks to said shaft by bonding said ankle portions to the side surface portions of the lower end portion of the shaft.

15. The method as recited in claim 1, further comprising:

a. forming said end taper by forming in the core portion of the lower end of the shaft an upwardly extending tapered groove to form the lower end portion of the shaft as two tapered leg portions, and then joining said leg portions one to another, b. forming two slots in the lower end portion of the shaft, and inserting in said slots a pair of reinforcing members, said reinforcing members each having a web portion extending into said interior blade space, c. providing each blank with a rear ankle portion, and attaching said blanks to said shaft by bonding said ankle portions to the side surface portions of the lower end portion of the shaft, and d. joining said blanks to one another in a manner that upper edges of said blanks are joined together from the toe portions of the blanks rearwardly to form an upper bonded edge, with lower edge portions of the blanks below the upper bonded edge being spaced from one another, whereby after said interior blade space is filled with said hardenable filler material, the finished blade has a configuration which diverges downwardly from an upper edge of the blade.

16. A hockey stick made according to the method of claim 1, wherein the two side surface portions of said shaft are load bearing portions to resist bending of the shaft, and said blade has two surface portions extending from the lower end of the shaft and converging towards one another toward a toe portion of the blade.

17. The hockey stick as recited in claim 16, wherein the surface portions of the blade are joined to the side portions of the shaft to form a substantially continuous surface contour from the shaft to the blade.

18. The hockey stick as recited in claim 17, further comprising at least one reinforcing member having one portion thereof attached to said lower end portion of the shaft, and a second portion extending into and attaching to the filler material in the interior blade space.

19. A hockey stick comprising:

(a) an elongate shaft having a longitudinal axis, a bladewise axis, and a transverse axis perpendicular to the longitudinal axis and the bladewise axis, said shaft having a core portion and two side surface portions positioned generally parallel to the bladewise axis and to the longitudinal axis, said two side surface portions being load bearing portions to resist bending of the shaft about the bladewise axis, (b) said shaft having an upper end portion and a lower end portion, said lower end portion tapering downwardly and inwardly toward said bladewise axis, with the side surface portions extending downwardly and inwardly along the lower end portion of the shaft, (c) a blade having a front toe portion and a rear heel portion joining to said shaft, said blade comprising two blade surface portions joining to one another at said toe portion and diverging rearwardly from one another to join to said lower shaft lower end portion, and (d) said blade having a hardened filler material occupying a space between the two blade surface portions, said filler material having a cross sectional dimension occupying a substantial portion of the thickness of said blade.

20. The hockey stick as recited in claim 19, wherein the lower end of the shaft comprises two downwardly tapering leg portions joined one to another along said longitudinal axis.

21. The hockey stick as recited in claim 20, wherein there is a filler material between two said leg portions, with said leg portions being joined one to another through said filler material.

22. The hockey stick as recited in claim 20, further comprising at least one reinforcing member positioned in a slot in the lower end portion of said shaft, and extending into the space between the two blade surface portions and bonded to the hardened filler material.

23. The hockey stick as recited in claim 20, wherein there are at least two reinforcing members positioned in slots in the lower end portion of the shaft, with each reinforcing member having a forward web portion extending into the space between the blade surface portions and bonded to the filler material in said space.

24. The hockey stick as recited in claim 19, wherein there is at least one reinforcing member positioned in a slot in the lower end portion of said shaft, and extending into the space between the two blade surface portions and bonded to the hardened filler material.

25. The hockey stick as recited in claim 19, wherein there are at least two reinforcing members positioned in slots in the lower end portion of the shaft, with each reinforcing member having a forward web portion extending into the space between the blade surface portions and bonded to the filler material in said space.

26. The hockey stick as recited in claim 19, wherein the two side surface portions of the shaft are two laminated portions, each having an inner layer and an outer layer of fibre reinforced material.

27. The hockey stick as recited in claim 26, wherein said fibre reinforced material comprises a fibre glass mat.

28. The hockey stick as recited in claim 19, wherein said blade surface portions each have a rear ankle portion, said rear ankle portions being bonded to the side surface portions at the lower end portion of the shaft.

29. The hockey stick as recited in claim 28, wherein said blade surface portions are joined to one another in a manner that upper edges of the blade surface portions are joined together from the toe portion of the blade rearwardly in the form of an upper bonded edge, with lower edge portions of the blade surface portions below the upper bonded edge being spaced from one another, with filler material being positioned between said lower edge portions.

30. The hockey stick as recited in claim 29, wherein said blade surface portions each have a fibre reinforced material bonded to an outer surface thereof.

31. The hockey stick as recited in claim 19, wherein:

a. the lower end of the shaft comprises two downwardly tapering leg portions joined one to another along said longitudinal axis b. said blade surface portions each have a rear ankle portion, said rear ankle portions being bonded to the side surface portions at the lower end portion of the shaft.

32. The hockey stick as recited in claim 19, wherein:

a. the lower end of the shaft comprises two downwardly tapering leg portions joined one to another along said longitudinal axis b. there are at least two reinforcing members positioned in slots in the lower end portion of the shaft, with each reinforcing member having a forward web portion extending into the space between the blade surface portions and bonded to the filler material in said space c. said blade surface portions each have a rear ankle portion, said rear ankle portions being bonded to the side surface portions at the lower end portion of the shaft d. said blade surface portions are joined to one another in a manner that upper edges of the blade surface portions are joined together from the toe portion of the blade rearwardly in the form of an upper bonded edge, with lower edge portions of the blade surface portions below the upper bonded edge being spaced from one another, with filler material being positioned between said lower edge portions.

33. A method of making a hockey stick, said method comprising:

(a) forming in a shaft an end groove, said shaft having a longitudinal axis, a bladewise axis, and a transverse axis perpendicular to the longitudinal axis and the bladewise axis, said shaft having a core portion and two side surface portions positioned generally parallel to the bladewise axis and the longitudinal axis, said shaft having an upper end portion and a lower end portion, said groove being formed at said lower end portion by removing a part of the core portion to form in the core portion of the lower end portion of the shaft an upwardly extending and inwardly tapered groove to form the lower end portions of the shaft as two tapered leg portions, (b) joining said leg portions one to another to form the shaft with a lower end taper, in a manner that said side surface portions converge downwardly and inwardly along said lower end portions to a location proximate a lower end of said shaft, (c) attaching to the lower end of the shaft a blade member to form a finished hockey stick.

34. The method as recited in claim 33, further comprising placing a filler material between said leg portions so that said two leg portions are joined one to another through said filler material, with said filler material having sufficient thickness to occupy a portion of space previously occupied by material removed.

35. A method of making a hockey stick, said method comprising:

a. providing an elongate shaft having an upper end portion and a lower end portion, b. providing two blade blanks, said blanks each having a front toe portion and a rear portion, joining the toe portions to one another and attaching the rear portions to the shaft in a manner that the blade blanks diverge rearwardly from one another to provide an interior blade space therebetween, and c. filling said interior blade space at least partially with a hardenable filler material to form a finished blade.

36. The method as recited in claim 35, further comprising providing each blank with a rear ankle portion, and attaching said blanks to said shaft by bonding said ankle portions to side surface portions of the lower end of the shaft.

37. The method as recited in claim 36, further comprising joining said blanks to one another in a manner that upper edges of said blanks are joined together from the toe portions of the blanks rearwardly to form an upper bonded edge, with lower edge portions of the blanks below the upper bonded edge being spaced from one another, whereby after said interior blade space is filled with said hardenable filler material, the finished blade has a configuration which diverges downwardly from an upper edge of the blade.

38. The method as recited in claim 37, wherein said blanks are joined to one another by laying said blanks one against the other and placing a separating member between rear portions of the blanks, said separating member having a forward separating edge that extends from the upper edges of the blanks downwardly and forwardly toward the lower edges of the blanks, whereby there is formed a bonded area which reaches upwardly and rearwardly along said blanks.

39. The method as recited in claim 37, wherein said blanks are joined one to another by laying said blanks one against the other, placing fibre reinforced material against outside surfaces of said blanks, placing a separating member between rear portions of said blanks, and then bonding said blanks and said fibre reinforced material so that fibre reinforced laminations are formed on exterior surfaces of said blanks, while rear portions of said blanks are separated from one another.

* * * * *